US008958568B2

(12) United States Patent
Sakamoto et al.

(10) Patent No.: US 8,958,568 B2
(45) Date of Patent: Feb. 17, 2015

(54) ACTIVE NOISE CONTROLLER

(75) Inventors: Kosuke Sakamoto, Utsunomiya (JP); Toshio Inoue, Tochigi-ken (JP); Akira Takahashi, Tochigi-ken (JP); Yasunori Kobayashi, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 771 days.

(21) Appl. No.: 12/994,025

(22) PCT Filed: Feb. 19, 2009

(86) PCT No.: PCT/JP2009/052882

§ 371 (c)(1),
(2), (4) Date: Nov. 22, 2010

(87) PCT Pub. No.: WO2009/144976

PCT Pub. Date: Dec. 3, 2009

(65) Prior Publication Data

US 2011/0075854 A1 Mar. 31, 2011

(30) Foreign Application Priority Data

May 29, 2008 (JP) ..... 2008-140298

(51) Int. Cl.
*G10K 11/178* (2006.01)

(52) U.S. Cl.
CPC ..... *G10K 11/1788* (2013.01); *G10K 2210/128* (2013.01); *G10K 2210/3044* (2013.01)
USPC ..... 381/71.1

(58) Field of Classification Search
CPC ..... G10K 11/1788; G10K 11/178; G10K 2210/1081
USPC ..... 381/71.1–71.9, 71.11–71.14, 381/94.1–94.4, 86; 181/206
See application file for complete search history.

(56) References Cited

U.S. PATENT DOCUMENTS

| | | | | |
|---|---|---|---|---|
| 5,638,305 | A | 6/1997 | Kobayashi et al. | |
| 7,574,006 | B2 * | 8/2009 | Funayama et al. | 381/71.12 |
| 7,773,760 | B2 * | 8/2010 | Sakamoto et al. | 381/71.9 |
| 2006/0056642 | A1 * | 3/2006 | Inoue et al. | 381/71.11 |
| 2007/0172004 | A1 | 7/2007 | Funayama et al. | |

FOREIGN PATENT DOCUMENTS

| | | | |
|---|---|---|---|
| EP | 1772852 | A1 | 4/2007 |
| JP | 2007-25527 | A | 2/2007 |

OTHER PUBLICATIONS

Bernard Widrow et al., "Adaptive Signal Processing" Sandia National Laboratories, 1985, p. 317, Prentice Hall, Inc., Englewood Cliffs, New Jersey 07632.

* cited by examiner

*Primary Examiner* — Lun-See Lao
(74) *Attorney, Agent, or Firm* — Carrier Blackman & Associates, P.C.; Joseph P. Carrier; William D. Blackman

(57) ABSTRACT

On an active noise controller, an adjustment reference signal generator generates an adjustment reference signal Sra by reading the waveform data sequentially at a read location shifted by a given amount from a read location for a reference signal Sr with respect to the waveform data at a reference signal generator. A one-tap adaptive filter generates a control signal Scp by multiplying the adjustment reference signal Sra by a filter factor W. A gain controller outputs a compensation control signal Sca generated by multiplying the control signal Scp by gain G. A speaker outputs the compensation control signal Sca as a cancellation sound.

3 Claims, 9 Drawing Sheets

18
TO SPEAKERS
FROM MICROPHONE
37
D/A
35
D/A
46
32
Sca
e1
20
42
G
44
28
Sc
e2
42a
42b
Scp
60
28a
28b
58
$Z^{-1}$
36
COPY
Ws
Ws
e2
LMS
Wc
Wc
LMS
38a
38b
38
COPY
Srac
Sras
Src
Srs
WAVEFORM DATA TABLE
34
56
FIRST ADDRESS SHIFTER
SECOND ADDRESS SHIFTER
54
40
ADDRESS CONVERTER
50
π/4 PHASE SHIFTER
52
22

| ADDRESS | WAVEFORM DATA |
|---|---|
| 0 | 0 |
| 1 | $A\sin(360° \times \frac{1}{N})$ |
| ⋮ | ⋮ |
| i | $A\sin(360° \times \frac{i}{N})$ |
| ⋮ | ⋮ |
| N | $A\sin(360° \times \frac{N-1}{N})$ |

ACTIVE NOISE CONTROLLER

TECHNICAL FIELD

The present invention relates to an active noise control apparatus (active noise controller) for reducing noise that is generated in a space such as a vehicle passenger compartment by generating a canceling sound, which is in opposite phase to and has an amplitude nearly equal to the noise, for causing interference between the generated canceling sound and the noise.

BACKGROUND ART

When a vehicle travels on a road, wheel vibrations in reaction to the road are transmitted via the suspension to the vehicle body, and are excited by acoustic resonant properties of a closed space such as the vehicle passenger compartment, thereby generating road noise (muffled sounds referred to as "drumming noise") having a peak at about 40 [Hz], and a bandwidth ranging from 20 to 150 [Hz]. An active noise control apparatus has been proposed for canceling out such road noise with canceling sounds which are in opposite phase to the road noise at an evaluation point (listening point) where a microphone is positioned (see Japanese Laid-Open Patent Publication No. 2007-025527).

The active noise control apparatus has an adaptive notch filter acting as a noise canceller (see "ADAPTIVE SIGNAL PROCESSING" by Bernard Widrow, Stanford University, Samuel D. Stearns, Sandia National Laboratories, 1985, Prentice-Hall, Inc., Englewood Cliffs, N.J. 07632 (FIG. 12.6, Page 317)). The active noise control apparatus generates a control signal dependent on the canceling sounds by having the adaptive notch filter function as a notch filter, which has a prescribed central frequency (road noise frequency) and passband.

DISCLOSURE OF THE INVENTION

When a sound cancellation control process is performed on noise having a prescribed bandwidth, such as road noise, if the sound canceling region is brought into conformity with the above bandwidth by a feedback active noise control apparatus, then frequency regions on both sides of the sound canceling region on the frequency axis become sound-augmented regions.

More specifically, if the adaptive notch filter has a central frequency (road noise frequency) of 40 [Hz], then a control unit including the adaptive notch filter has an amplitude characteristic curve 90, which is negative in a band ranging from 35 [Hz] to 45 [Hz], thus providing good control capability (sound cancellation capability). However, the amplitude characteristic curve 90 is positive in a band ranging from 25 [Hz] to 35 [Hz] and in a band ranging from 45 [Hz] to 55 [Hz], which become sound-augmented regions where the sound canceling control process does not function effectively.

This is because, as shown in FIG. 7, when the phase of a canceling signal is adjusted by a phase shifter (delay unit) in the control unit in order to bring the canceling sound into opposite phase to the road noise at the evaluation point where the microphone is installed, a phase characteristic curve 82 of the control unit is changed as the frequency changes. Consequently, at frequencies (35 [Hz], 45 [Hz]) around the frequency (40 [Hz]) to be canceled, the control unit is unable to maintain an effective control capability due to the frequency change (phase delay) of the phase characteristic curve 82.

If the sound canceling region is narrowed in order to eliminate the effects of sound augmentation, then a further phase delay occurs at the frequency to be canceled, and an increase is caused in the rate of change of phase to frequency, thus resulting in a reduction in the bandwidth within which noises can be canceled, and hence, in a reduced control capability.

An object of the present invention is to make it possible to adjust the phase of a canceling signal without the use of a phase shifter (delay unit), and to maintain a sound cancellation capability (control capability) by reducing phase changes of the canceling signal with respect to frequencies, thereby widening the frequency band within which noises can be canceled.

An active noise control apparatus according to the present invention comprises:

a canceling sound generator for generating a canceling sound for canceling noise;

an error signal detector for detecting an error signal based on a difference between the noise and the canceling sound;

a waveform data table for storing predetermined waveform data;

a reference signal generator for generating a reference signal based on the frequency of the noise, by successively reading the waveform data from the waveform data table;

a first adaptive filter for multiplying the reference signal by a filter coefficient to generate a control signal;

a subtractor for subtracting the control signal from the error signal to generate a corrected error signal;

a filter coefficient updater for sequentially updating the filter coefficient of the first adaptive filter to minimize the corrected error signal, based on the reference signal and the corrected error signal;

an adjustment reference signal generator for generating an adjustment reference signal by successively reading waveform data from the waveform data table from a read position, which is shifted a prescribed quantity from a read position used for reading the reference signal from the waveform data; and a second adaptive filter for multiplying the adjustment reference signal by the filter coefficient to generate a canceling signal, wherein the canceling sound generator generates the canceling sound based on the canceling signal.

According to the present invention, the adjustment reference signal is generated from the read position that is shifted a prescribed quantity from the read position at which the reference signal is read, and the generated adjustment reference signal is multiplied by the filter coefficient in order to generate the control signal. Since the adjustment reference signal generator generates the adjustment reference signal, which is shifted in phase by a phase quantity depending on the prescribed quantity from the reference signal, and using the waveform data stored in the waveform data table, the canceling signal is shifted in phase from the reference signal by the phase quantity. Consequently, the active noise control apparatus is capable of adjusting the phase of the canceling signal without the need for a phase shifter (delay unit). Since no phase shifter is required, frequency dependent phase changes in the canceling signal are reduced, thereby making it possible to maintain the sound cancellation capability (control capability), and widening the frequency band within which sound cancellation is possible.

The active noise control apparatus preferably further comprises an amplitude adjuster for adjusting the amplitude of the canceling signal, and outputting the adjusted canceling signal to the canceling sound generator.

The phase of (the adjustment reference signal depending on) the canceling signal for generating the canceling sound is adjusted by the adjustment reference signal generator, so that the canceling sound is opposite in phase to and has an amplitude nearly equal to the noise at an evaluation point where the error signal detector is located. Also, the amplitude of the canceling signal is adjusted by the amplitude adjuster. The phase and amplitude of the canceling signal can thus be adjusted easily for efficiently canceling noises at the evaluation point.

More specifically, the adjustment reference signal generator uses, as the prescribed quantity, a phase quantity corresponding to a value (−1/C), which is produced by multiplying the reciprocal of the sound transfer characteristics from the canceling sound generator to the error signal detector by −1, and the adjustment reference signal generator generates the adjustment reference signal, which is shifted in phase from the reference signal by the phase quantity. It is thus possible to generate canceling sounds, which are reliably in opposite phase to and have an amplitude nearly equal to the noise at the evaluation point. Hence, noises at the evaluation point can reliably be reduced.

BEST MODE FOR CARRYING OUT THE INVENTION

Figure 1:
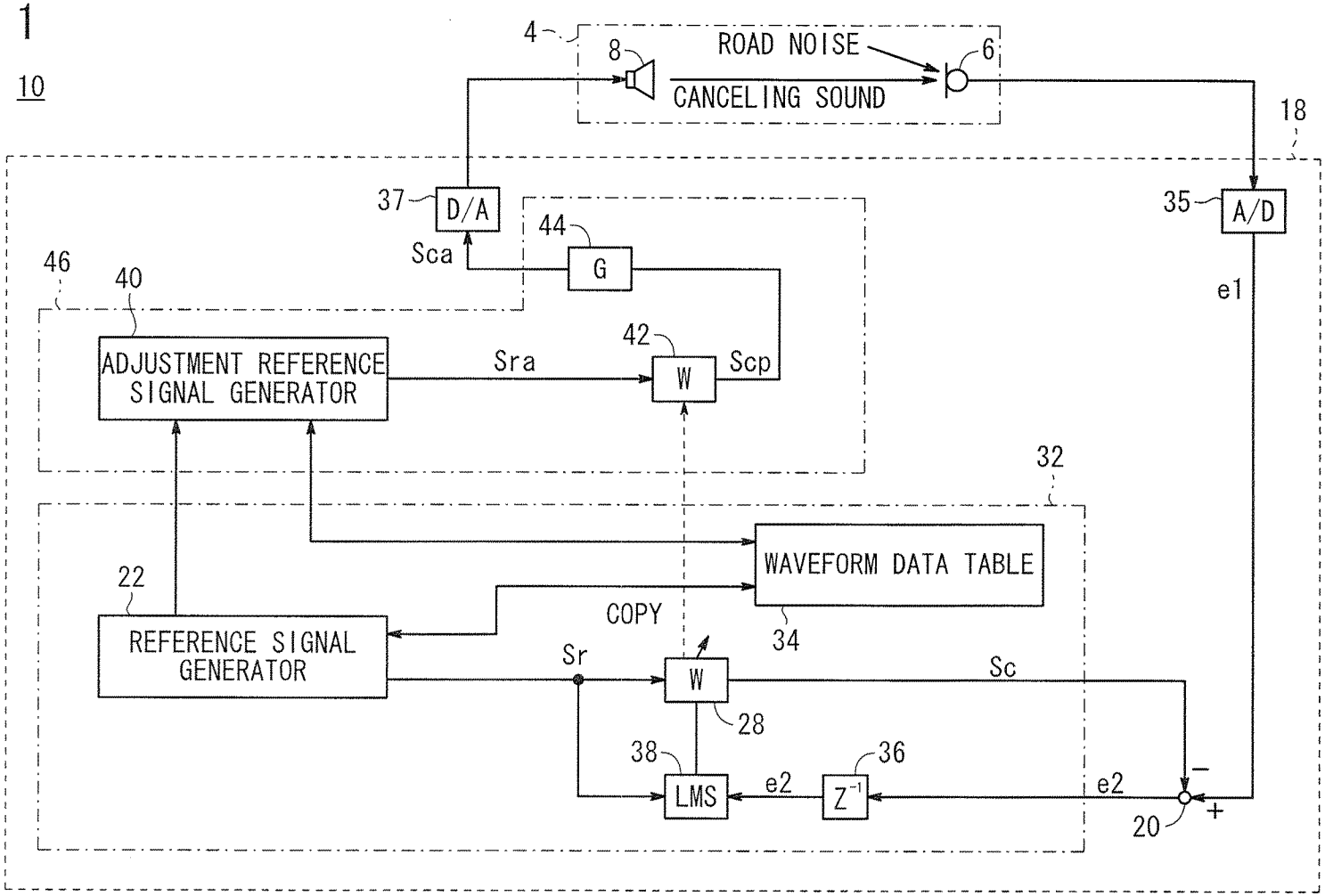
FIG. 1 is a block diagram showing a configuration of an active noise control apparatus according to an embodiment of the present invention.
Figure 2:
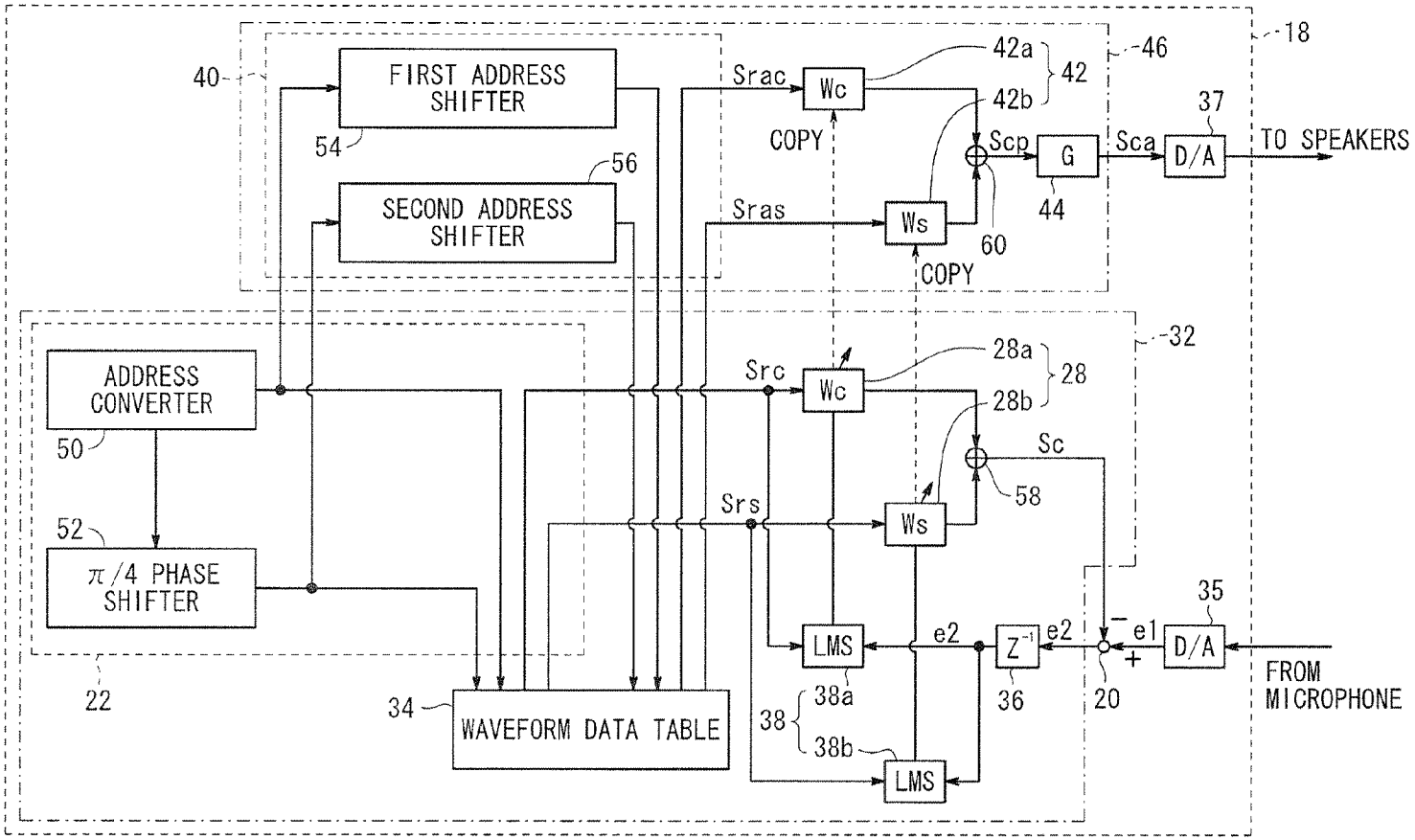
FIG. 2 is a block diagram showing a detailed configuration of the active noise control apparatus shown in FIG. 1.

As shown in FIGS. 1 and 2, an active noise control apparatus (hereinafter also referred to as "ANC apparatus") 10 according to an embodiment of the present invention basically comprises speakers (canceling sound generator) 8 for outputting canceling sounds represented by a corrected control signal Sca, which comprises a control signal Scp having a corrected amplitude (gain), a microphone (error signal detector) 6 for outputting (detecting) as an error signal e1 represented by residual noise due to interference between road noises (road noises having a prescribed frequency) at an evaluation point and the canceling sounds for canceling out the road noise, and an active noise controller 18, which is supplied with the error signal e1 from the microphone 6 and which outputs the corrected control signal Sca.

The microphone 6, which receives the road noises and the canceling sounds for canceling out the road noises, is located at an anti-node position in a primary or secondary mode of the specific acoustic mode in the longitudinal direction of a vehicle passenger compartment space 4 (i.e., at a position where the sound pressure of a standing wave of the resonant sound at 40 [Hz] in the vehicle passenger compartment, among road noises having a bandwidth ranging from 20 to 150 [Hz]). Specifically, if the vehicle is a sedan, then the microphone 6 is located at a position, for example, near a front position in a closed space represented by a cross section in the transverse direction of the vehicle, or more specifically, at a position near a foot space in front of a front seat, at a position near a room mirror, or at a position in the back of an instrument panel.

The speakers 8 are disposed on left and right kick panels at the front seats of the vehicle, on a central lower portion of the instrument panel, and on left and right body portions at lower portions of C pillars at the rear seats of the vehicle, for example, for intensifying the surround effect of a 5-channel surround sound system. The woofer, which represents the "0.1" channel, may be disposed in any desired position since it has almost no directionality.

The active noise controller 18 includes a computer, which operates as a function realizing means for realizing various functions when a CPU executes programs stored in a memory, such as a ROM or the like, based on various input signals.

The active noise controller 18 has an A/D converter 35, which converts an analog error signal e1 detected by the microphone 6 into a digital error signal e1, and which supplies the digital error signal e1 to a minuend input terminal of a subtractor 20. The active noise controller 18 also has a D/A converter 37, which converts a digital corrected control signal Sca into an analog corrected control signal Sca, and which supplies the analog corrected control signal Sca to the speakers 8.

The active noise controller 18 also includes an adaptive notch filter 32 and a phase and gain adjuster 46, in addition to the A/D converter 35, the D/A converter 37, and the subtractor 20.

The subtractor 20 subtracts a control signal Sc from the error signal e1, thereby generating a corrected error signal e2, and supplies the corrected error signal e2 to a one-sample-time delay unit ($Z^{-1}$) 36 of the adaptive notch filter 32, so that a filter coefficient updater (algorithm processor) 38 can utilize the corrected error signal e2 in the next sampling cycle.

The adaptive notch filter 32 includes, in addition to the one-sample-time delay unit 36, a reference signal generator 22, a one-tap adaptive filter 28 (adaptive filters 28*a*, 28*b*) as a first adaptive filter, a waveform data table 34, a filter coefficient updater 38 (filter coefficient updaters 38*a*, 38*b*), and an adder 58.

Figures 3A, 3B:
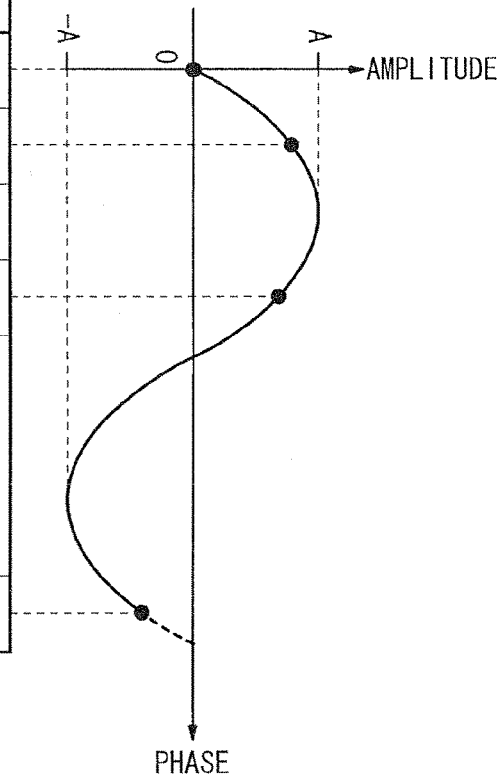
FIGS. 3A and 3B are diagrams of waveform data stored in a waveform data table.

The reference signal generator 22 successively reads waveform data, as shown in FIG. 3A, from the waveform data table 34, to thereby generate a cosine-wave signal Src {Src=cos (2πfdt)} and a sine-wave signal Srs {Srs=sin(2πfdt)}, each of which has a road noise frequency fd (fd=40 [Hz] in the present embodiment) serving as a reference signal Sr. The adaptive filter 28*a* multiplies the cosine-wave signal Src by a filter coefficient Wc and outputs the resultant product, whereas the adaptive filter 28*b* multiplies the sine-wave signal Srs by the filter coefficient Ws and outputs the resultant product. The adder 58 outputs a sum signal Wc×Src+Ws×Srs as the control signal Sc. The filter coefficient updater 38*a* updates the filter coefficient Wc of the adaptive filter 28*a* based on the cosine-wave signal Src and the corrected error signal e2 according to an adaptive control algorithm, e.g., an LMS (Least Means Square) algorithm, which is one type of steepest descent method, in order to minimize the corrected error signal e2. The filter coefficient updater 38*b* updates the filter coefficient Ws of the adaptive filter 28*b* based on the sine-wave signal Srs and the corrected error signal e2, according to an adaptive control algorithm (e.g., an LMS algorithm), in order to minimize the corrected error signal e2.

FIGS. 3A through 4C are diagrams that illustrate generation of the reference signal Sr (the sine-wave signal Srs and the cosine-wave signal Src) by the reference signal generator 22 using the waveform data table 34.

As shown schematically in FIGS. 3A and 3B, the waveform data table 34 stores instantaneous value data, representative of a given number (N) of instantaneous values of one period of a sine waveform along the time axis, as waveform data at respective addresses. The addresses (i) are represented by integers (i=0, 1, 2, . . . , N−1) ranging from 0 to the given number N minus 1. In FIGS. 3A and 3B, A may be represented by 1, or by any desired positive real number. Therefore, the waveform data at the address i is calculated as Asin(360°× i/N). In other words, the waveform data table 34 divides one cycle of a sine wave into N samples over time, and stores therein quantized data of instantaneous values of the sine wave at the sampling points, as waveform data at respective addresses represented by the sampling points.

The reference signal generator 22 includes an address converter 50 (see FIG. 2), which specifies an address based on the road noise frequency fd as a read address for the waveform data table 34, and a π/4 phase shifter 52, which specifies an address produced by shifting the address specified by the address converter 50 by one fourth (¼) period (90[°] or π/4 radians), as a read address for the waveform data table 34.

Figure 4A:
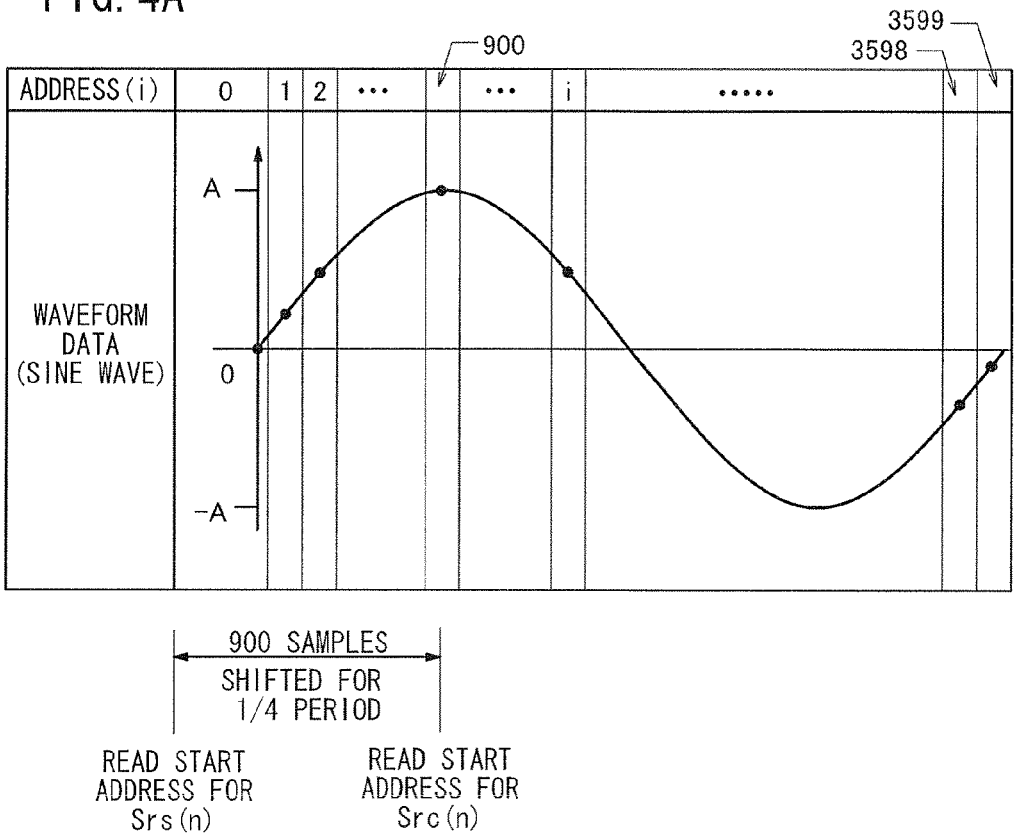
FIGS. 4A through 4C are diagrams schematically illustrating the manner in which a reference signal is generated by a reference signal generator shown in FIGS. 1 and 2.
Figure 4B:
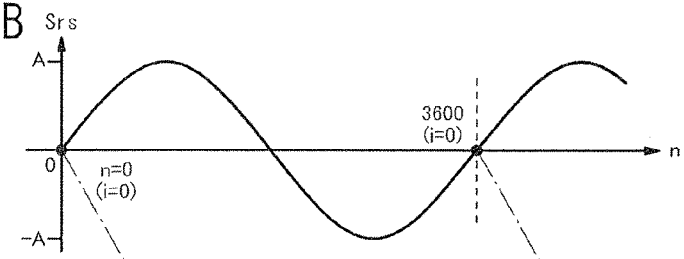
Figure 4C:
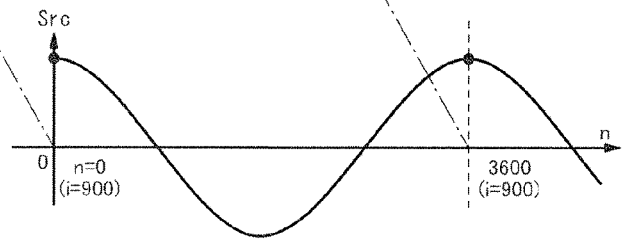

FIGS. 4A through 4C are diagrams schematically illustrating the manner in which the reference signal Sr is generated by the reference signal generator 22. In FIGS. 4A through 4C, n denotes an integer of 0 or greater, which represents a sampling count (time signal count) in the adaptive notch filter 32. FIG. 4A schematically shows the relationship between the addresses and waveform data of the waveform data table 34. FIG. 4B schematically shows generation of a sine-wave signal Srs. FIG. 4C schematically shows generation of a cosine-wave signal Src.

Generation of the reference signal Sr will be described below, based on the premise that waveform data are sampled at certain sampling periods (fixed sampling process). As shown in FIGS. 3A through 4C, the given number (N) is assumed to be 3600. Therefore, addresses are represented by i=0, 1, 2, . . . , N−1=0, 1, 2, 3599, and the specified addresses are shifted by N/4=900. For the sake of brevity, a sampling interval (time) t is defined as t=1/N=1/3600 [s].

Since the sampling interval is 1/3600 [s] (1/N [s]), the address converter 50 specifies a read address i(n) at an address interval is, based on the road noise frequency fd at a given sampling time, according to the following equation (1):

$$is=N\times fd\times t=3600\times fd\times 1/3600=fd \quad (1)$$

Therefore, the address i(n) at a certain timing is expressed by the following equation (2):

$$i(n)=i(n-1)+is=i(n-1)+fd \quad (2)$$

When i(n)>3599 (=N−1), the address i(n) is expressed by the following equation (3):

$$i(n)=i(n-1)+fd-3600 \quad (3)$$

Thus, the reference signal generator 22 generates a sine-wave signal Srs(n) by successively reading waveform data from the waveform data table 34 at the address interval is corresponding to the road noise frequency fd at the respective sampling times. Specifically, if fd=40 [Hz], then when the control process is started, the reference signal generator 22 successively reads waveform data at addresses i(n)=0, 40, 80, 120, . . . , 3560, 0, . . . at respective sampling times, i.e., 1/3600 [s], thereby generating the sine-wave signal Srs(n) at 40 [Hz].

The π/4 phase shifter 52 specifies, as a read address i'(n), an address that is produced by shifting (adding) the read address i(n) for the sine-wave signal Srs(n), which is output from the address converter 50 (specified by the address converter 50) by one fourth (¼) period from sin(θ+π/2)=cosθ according to the following equation (4):

$$i'(n)=i(n)+N/4=i(n)+900 \quad (4)$$

When i'(n)>3599 (=N−1), the read address i'(n) is expressed by the following equation (5):

$$i'(n)=i(n)+900-3600 \quad (5)$$

Therefore, the reference signal generator 22 generates the sine-wave signal Srs(n) by successively reading waveform data from the waveform data table 34 at an address interval corresponding to the frequency fd at respective sampling times from the address i'(n), which is shifted by one fourth (¼) period from the address i(n) of the sine-wave signal Srs(n).

If fd=40 [Hz], then when the control process is started, the reference signal generator 22 successively reads the waveform data at addresses i'(n)=900, 940, 980, 1020, . . . , 860, 900, . . . at respective sampling times, i.e., 1/3600 [s], thereby generating the cosine-wave signal Src(n) at 40 [Hz].

Generation of the reference signal Sr (the sine-wave signal Srs, and the cosine-wave signal Src) by the reference signal generator 22 using the waveform data table 34 has been described above.

As shown in FIGS. 1 and 2, the phase and gain adjuster 46 includes an adjustment reference signal generator 40, a one-tap adaptive filter 42 (adaptive filters 42*a*, 42*b*) serving as a second adaptive filter, a gain adjuster (amplitude adjuster) 44, and an adder 60.

As described later, the adjustment reference signal generator 40 successively reads waveform data from the waveform data table 34, from read addresses that are shifted a given quantity (depending on an angle θa) from the read addresses used for reading the reference signal Sr (the sine-wave signal Srs and the cosine-wave signal Src) from the waveform data (see FIGS. 3A and 3B), thereby generating an adjustment reference signal Sra (an adjustment sine-wave signal Sras and an adjustment cosine-wave signal Srac), which is shifted in phase from the reference signal Sr by the above given quantity. More specifically, the adjustment sine-wave signal Sras is expressed as Sras=sin(2πfdt+θa), and the adjustment cosine-wave signal is expressed as Srac as Srac=cos(2πfdt+θa). The adaptive filter 42*a*, to which the filter coefficient Wc of the adaptive filter 28*a* is copied, multiplies the adjustment cosine-wave signal Srac by the filter coefficient Wc and outputs the resultant product. The adaptive filter 42*b*, to which the filter coefficient Ws of the adaptive filter 28*b* is copied, multiplies the adjustment sine-wave signal Sras by the filter coefficient Ws and outputs the resultant product. The adder 60 outputs a sum signal Wc×Srac+Ws×Sras as the control signal Scp. The gain adjuster 44 multiplies the control signal Scp by a gain G, and outputs the product as the corrected control signal Sca.

Therefore, at the evaluation point where the microphone 6 is located, canceling sounds are brought into opposite phase to the road noises, and with an amplitude nearly equal to the road noises, thereby canceling road noises at the evaluation point. More specifically, the phase and gain adjuster 46 adjusts the phase and amplitude of the corrected control signal Sca in order to generate the canceling sounds, i.e., adjusts the phase of the adjustment control signal Sra and the amplitude of the control signal Scp for generating the corrected control signal Sca, so that the canceling sounds are in opposite phase to and with an amplitude nearly equal to the road noises.

If the sound transfer characteristics from the speakers 8 to the microphone 6 are represented by C, the road noise at the position (evaluation point) of the microphone 6 is represented by Nr, and the canceling sound output from the speakers 8 and reaching the microphone 6 is represented by Sca×C, then the road noises Nr and the canceling sounds Sca×C are related to each other according to the following equation (6):

$$Sca \times C + Nr = 0$$

$$Sca = Nr \times (-1/C) \tag{6}$$

Consequently, the adjustment reference signal generator 40 generates the adjustment reference signal Sra (adjusts the phase of the adjustment reference signal Sra) by shifting the phase of the reference signal Sr by the angle θa, which represents a phase corresponding to (−1/C) in the equation (6), so that the phase of the canceling sound Sca×C is opposite in phase to the road noise Nr. The gain adjuster 44 adjusts the amplitude of the control signal Scp based on the adjustment reference signal Sra (multiplies the control signal Scp by the gain G), so that the amplitude of the canceling sound Sca×C is nearly equal to the amplitude of the road noise Nr.

Figure 5A:
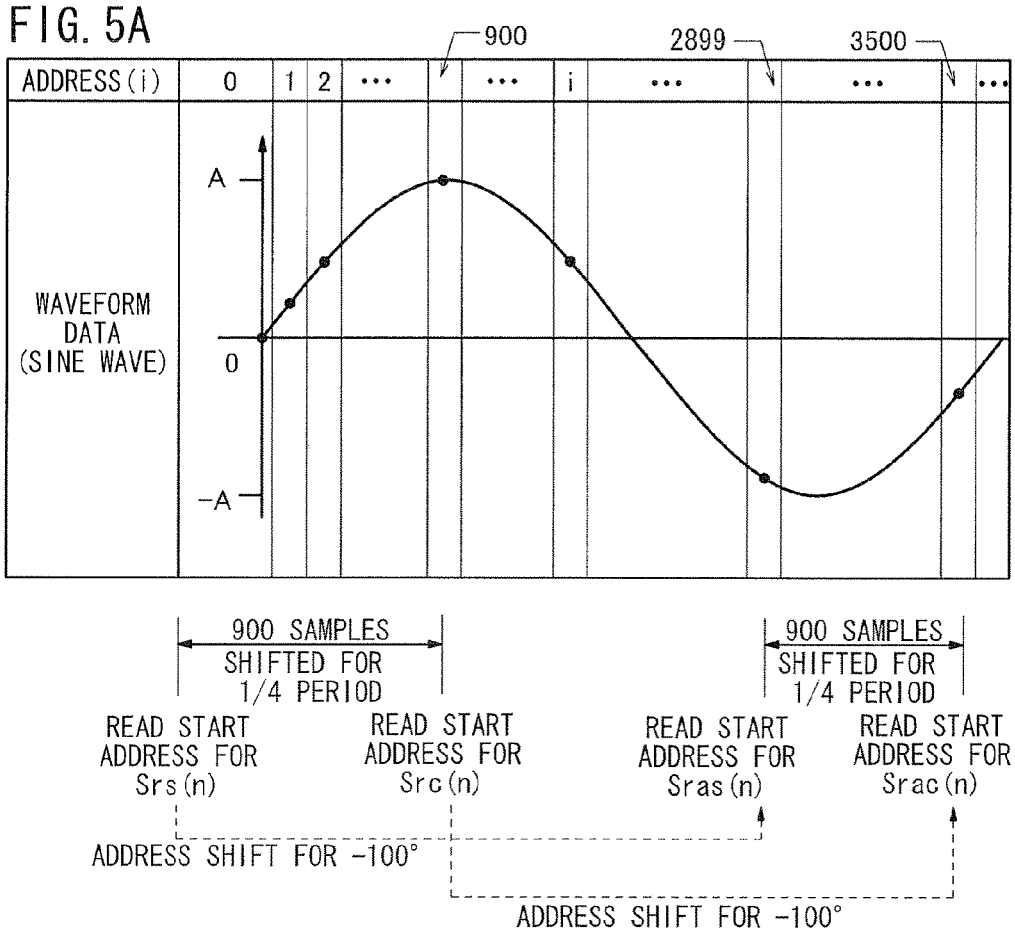
FIGS. 5A through 5C are diagrams schematically illustrating the manner in which an adjustment reference signal is generated by an adjustment reference signal generator shown in FIGS. 1 and 2.
Figure 5B:
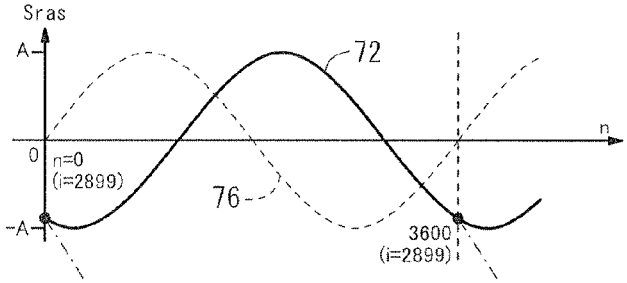
Figure 5C:
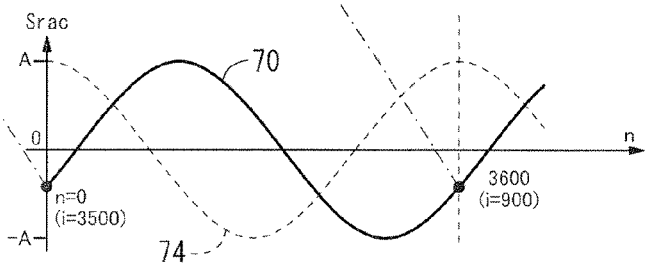

FIGS. 5A through 5C are diagrams schematically illustrating the manner in which the adjustment reference signal Sra is generated by the adjustment reference signal generator 40. FIG. 5A schematically shows the relationship between addresses and waveform data of the waveform data table 34. FIG. 5B schematically shows generation of the adjustment sine-wave signal Sras. FIG. 5C schematically shows generation of the adjustment cosine-wave signal Srac. In FIGS. 5B and 5C, the solid-line curves represent, respectively, a waveform 72 of the adjustment sine-wave signal Sras, and a waveform 70 of the adjustment cosine-wave signal Srac. The broken-line curves represent, respectively, a waveform 76 of the sine-wave signal Srs, and a waveform 74 of the cosine-wave signal Src.

The adjustment reference signal generator 40 includes a first address shifter 54 (see FIG. 2), which specifies, as a read address ia(n), an address that is produced by shifting (subtracting) the read address i(n) for the sine-wave signal Srs(n), which is output from the address converter 50 (specified by the address converter 50) by a quantity depending on the angle θa, according to the equation (7) shown below. It is assumed that θa=−100[°].

$$\begin{aligned} ia(n) &= i(n) + N \times (\theta a / 360) \\ &= i(n) - 1000 \end{aligned} \tag{7}$$

When i(n)>3599 (=N−1), the read address ia(n) is expressed by the following equation (8):

$$ia(n) = i(n) - 1000 - 3600 \tag{8}$$

Therefore, the first address shifter 54 generates the adjustment sine-wave signal Sras(n) by successively reading waveform data from the waveform data table 34 at an address interval corresponding to the frequency fd, and at respective sampling times from the address ia(n), which is shifted (subtracted) from the address i(n) of the sine-wave signal Srs(n) by the quantity depending on −100[°].

The adjustment reference signal generator 40 also includes a second address shifter 56, which specifies, as a read address i'a(n), an address that is produced by shifting (subtracting) the read address i'(n) for the cosine-wave signal Src(n), which is output from the π/4 phase shifter 52 (specified by the π/4 phase shifter 52) by a quantity depending on the angle θa=−100[°], according to the equation (9) shown below.

$$\begin{aligned} i'a(n) &= i'(n) + N \times (\theta a / 360) \\ &= i'(n) - 1000 \end{aligned} \tag{9}$$

When i'a(n)>3599(=N−1), the read address i'a(n) is expressed by the following equation (10):

$$i'a(n) = i'(n) - 1000 - 3600 \tag{10}$$

Therefore, the second address shifter 56 generates the adjustment cosine-wave signal Srac(n) by successively reading waveform data from the waveform data table 34 at an address interval corresponding to the frequency fd, and at respective sampling times from the address i'a(n), which is shifted (subtracted) from the address i'(n) of the cosine-wave signal Src(n) by the quantity depending on −100[°].

Advantages of the ANC apparatus 10 thus constructed will be described below with reference to FIGS. 6 through 9.

Figure 6:
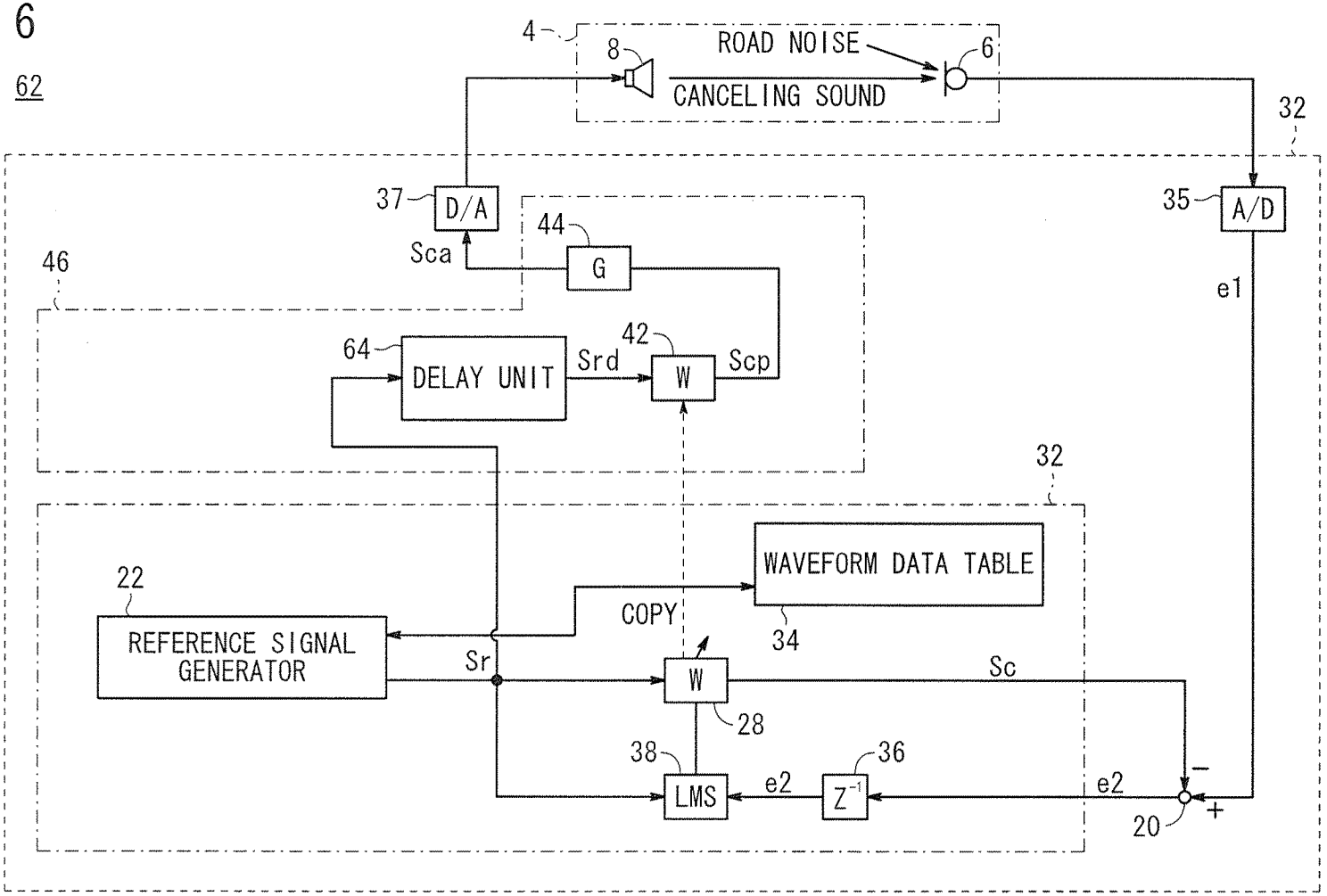
FIG. 6 is a block diagram showing a configuration of an active noise controller according to a comparative example.

FIG. 6 is a block diagram of an ANC apparatus 62 according to a comparative example. A phase and gain adjuster 46 includes a delay unit ($Z^{-N}$) 64 having an N-sample time delay, which operates as a phase shifter, instead of the adjustment reference signal generator 40. The delay unit 64 generates a delay reference signal Srd by delaying (phase-shifting) the reference signal Sr by an N-sample time, and outputs the generated delay reference signal Srd to the one-tap adaptive filter 42.

Figure 7:
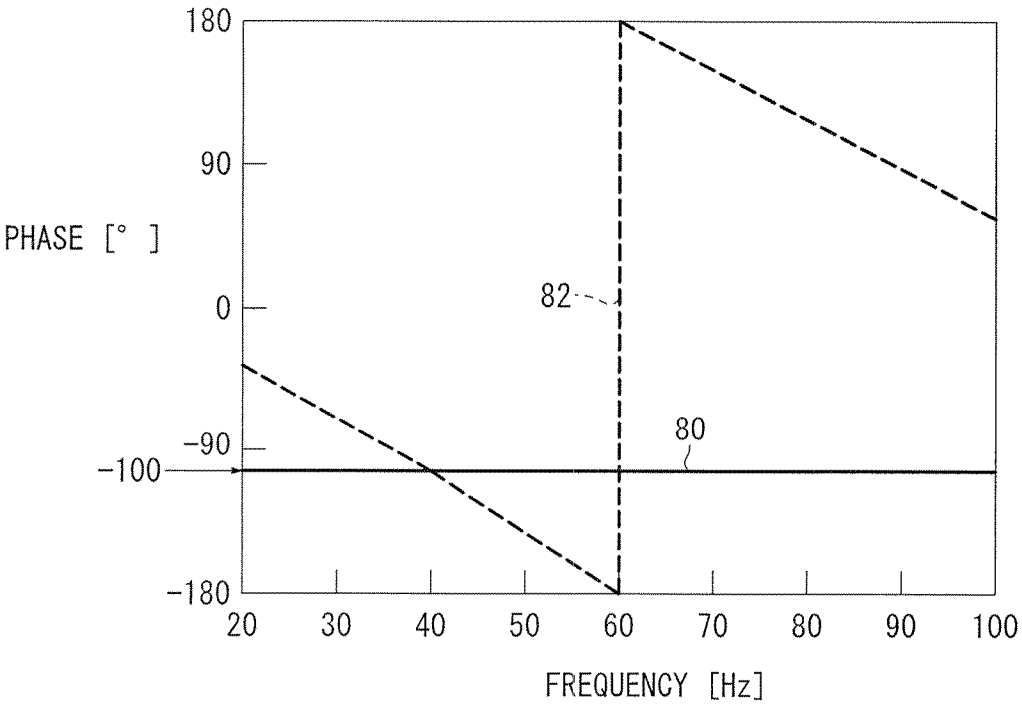
FIG. 7 is a diagram showing a phase characteristic curve of a phase and gain adjuster.

FIG. 7 is a diagram showing a phase characteristic curve of the phase and gain adjuster 46.

The phase and gain adjuster 46 of the ANC apparatus 62 according to the comparative example employs the delay unit 64, and generates a corrected control signal Sca based on the delay reference signal Srd, which is generated by delaying (phase-shifting) the reference signal Sr. Therefore, the phase and gain adjuster 46 has a phase characteristic curve 82, which changes as the frequency changes.

With the phase and gain adjuster 46 of the ANC apparatus 10 according to the present embodiment, however, the adjustment reference signal generator 40 uses waveform data stored in the waveform data table 34 in order to generate the adjustment reference signal Sr, which is shifted in phase from the reference signal Sr by θa=−100[°]. Then, the phase and gain adjuster 46 generates the corrected control signal Sca by multiplying the adjustment reference signal Sr by the filter coefficient W and the gain G. The phase and gain adjuster 46 has a phase characteristic curve 80, which is kept at a constant level (θa=−100[°]) regardless of frequency changes.

Figure 8:
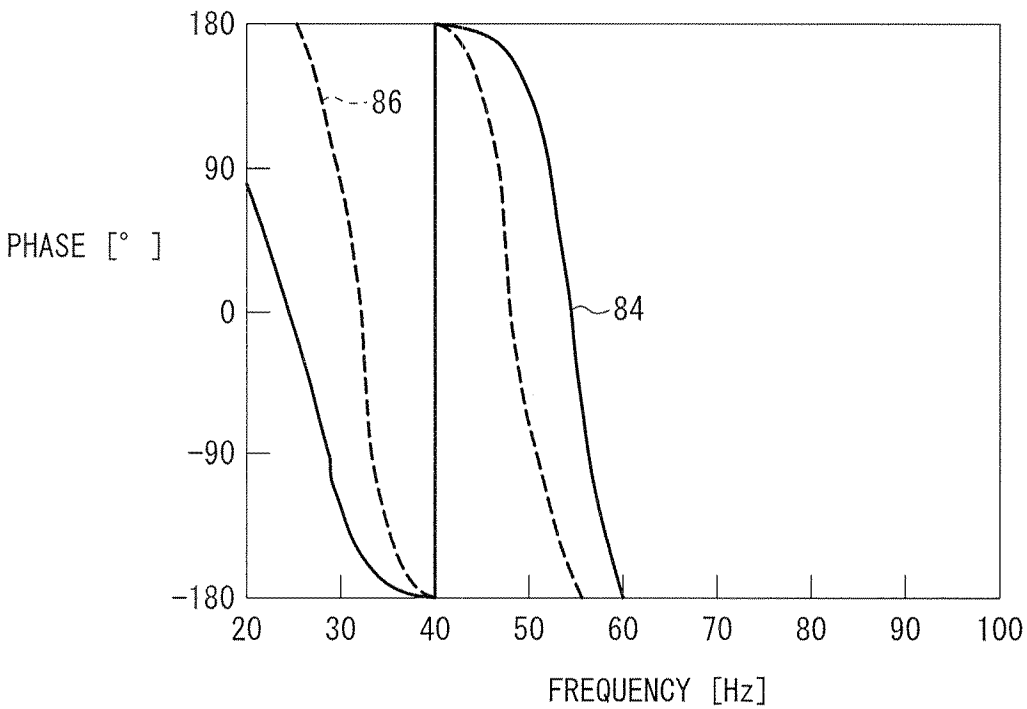
FIG. 8 is a diagram showing a closed loop characteristic curve of the active noise control apparatus (phase characteristic curves)
Figure 9:
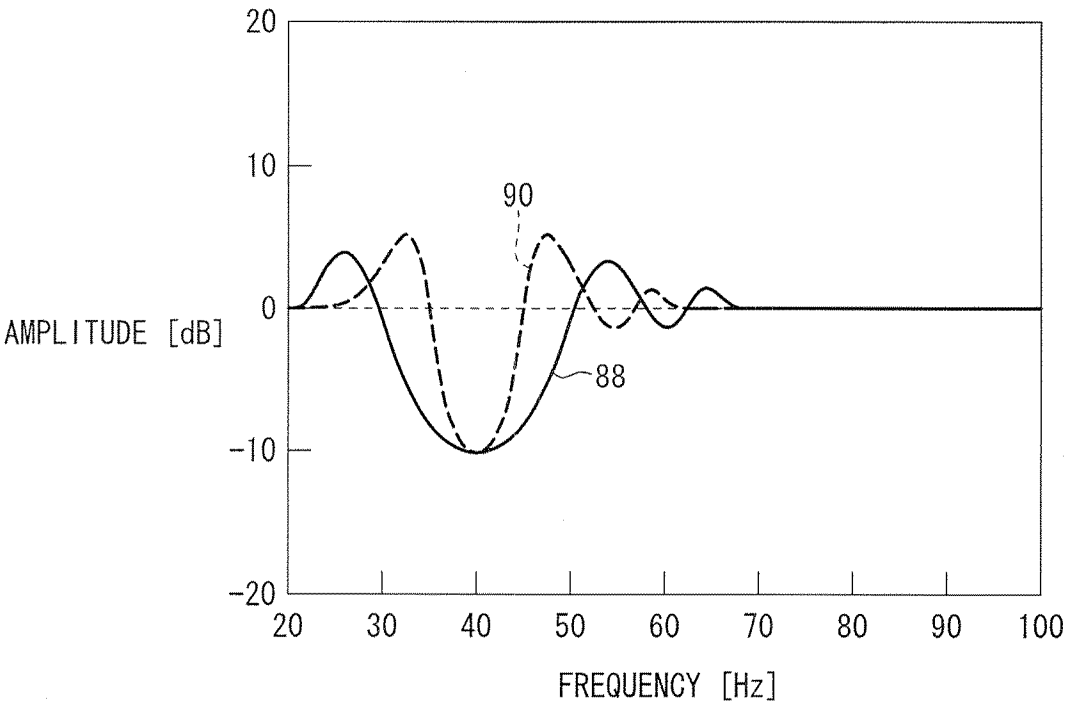
FIG. 9 is a diagram showing a closed loop characteristic curve of the active noise control apparatus (amplitude characteristic curves).

FIG. 8 is a diagram showing a closed loop characteristic curve of the ANC apparatus 10 (a phase characteristic curve 84 of the ANC apparatus 10, and a phase characteristic curve 86 of the ANC apparatus 62). FIG. 9 is a diagram showing a closed loop characteristic curve of the ANC apparatus 10 (an amplitude characteristic curve 88 of the ANC apparatus 10, and an amplitude characteristic curve 90 of the ANC apparatus 62).

With the amplitude characteristic curve 90 according to the comparative example, a band in a range from 35 [Hz] to 45

[Hz] about a central frequency of 40 [Hz] defines a frequency band in which the sound cancellation capability is maintained (negative region), whereas bands in a range from 25 [Hz] to 35 [Hz] and in a range from 45 [Hz] to 55 [Hz] are sound-augmented regions, in which the sound cancellation control does not function effectively (positive regions). Frequency regions lower than 35 [Hz] and higher than 45 [Hz] are shifted in phase by 90[°] or more from the central frequency (40 [Hz]), and form regions within which good sound cancellation capability cannot be maintained.

In the amplitude characteristic curve 88 according to the present embodiment, however, a band within a range from 30 [Hz] to 50 [Hz] about a central frequency of 40 [Hz] forms a frequency band (negative region) within which the sound cancellation capability is maintained. Therefore, in comparison with the amplitude characteristic curve 90 according to the comparative example, the frequency band within which the sound cancellation capability functions effectively is made wider.

This is because, as described above, the adjustment reference signal generator 40 uses waveform data stored in the waveform data table 34 in order to generate the adjustment reference signal Sr, which is shifted in phase from the reference signal Sr by θa=−100[°]. Consequently, the phase characteristic curve 80 of the phase and gain adjuster 46 is kept at a constant level (θa=−100[°]) regardless of frequency changes. As a result, it is possible to increase the frequency region within which good sound cancellation capability can be obtained.

As described above, the ANC apparatus 10 according to the present embodiment includes the speakers 8 for generating canceling sounds for canceling road noises, the microphone 6 for detecting the error signal e1 based on a difference between the road noises and the canceling sounds, the waveform data table 34 for storing waveform data, the reference signal generator 22 for generating the reference signal Sr based on the road noise frequency fd by successively reading waveform data from the waveform data table 34, the one-tap adaptive filter 28 for multiplying the reference signal Sr by the filter coefficient W in order to generate the control signal Sc, the subtractor 20 for subtracting the control signal Sc from the error signal e1 in order to generate the corrected error signal e2, the filter coefficient updater 38 for sequentially updating the filter coefficient W of the one-tap adaptive filter 28 so as to minimize the corrected error signal e2 based on the reference signal Sr and the corrected error signal e2, the adjustment reference signal generator 40 for generating the adjustment reference signal Sra by successively reading waveform data from the waveform data table 34, from a read position thereof that is shifted a prescribed quantity (depending on the angle θa) from a read position used for reading the reference signal Sr from the waveform data, and the one-tap adaptive filter 42 for multiplying the adjustment reference signal Sra by the filter coefficient W to thereby generate the control signal Scp.

The speakers 8 generate canceling sounds represented by the corrected control signal Sca, which is based on the control signal Scp.

The adjustment reference signal Sra is generated from the read position that is shifted a prescribed quantity from the read position used for reading the reference signal Sr, and the generated adjustment reference signal Sra is multiplied by the filter coefficient W in order to generate the control signal Scp. Since the adjustment reference signal generator 40 generates the adjustment reference signal Sra, which is shifted in phase from the reference signal Sr by the angle θa depending on the prescribed quantity, using the waveform data stored in the waveform data table 34, the control signal Scp and the corrected control signal Sca are shifted in phase from the reference signal Sr by the angle θa. Consequently, the ANC apparatus 10 can adjust the phase of the corrected control signal Scp (the control signal Scp) without the need for a phase shifter (delay unit). Since no phase shifter is required, frequency dependent phase changes in the corrected control signal Scp (the control signal Scp) are reduced, thereby making it possible to maintain the sound cancellation capability (control capability) and widening the frequency band within which sound cancellation is possible.

The ANC apparatus 10 also includes the gain adjuster 44 for adjusting the amplitude (gain) of the control signal Scp in order to generate the corrected control signal Sca.

The phase of (the adjustment reference signal Sra depending on) the corrected control signal Sca for generating the canceling sound is adjusted by the adjustment reference signal generator 40, so that the canceling sounds are opposite in phase to and have an amplitude nearly equal to the road noises at the evaluation point where the microphone 6 is located. Also, the amplitude of the control signal Scp (the corrected control signal Sca) is adjusted by the gain adjuster 44. The phase and amplitude of the corrected control signal Sca can thus be adjusted easily in order to efficiently cancel road noises at the evaluation point.

More specifically, the adjustment reference signal generator 40 generates the adjustment reference signal Sra, which is shifted in phase by an angle θa from the reference signal Sr, thus using the angle θa as a phase quantity corresponding to a value (−1/C), which is produced by multiplying the reciprocal of the sound transfer characteristics C from the speakers 8 to the microphone 6 by −1. Therefore, it is possible to generate canceling sounds, which are reliably in opposite phase to and have an amplitude nearly equal to road noises at the evaluation point. Thus, road noises at the evaluation point can be reduced reliably.

The present invention is not limited to the above-described embodiment. Various changes may be made to the embodiment based on the description and the drawings.

The invention claimed is:

1. A feedback active noise control apparatus for performing a sound cancellation control on road noise having a prescribed bandwidth, the active noise control apparatus, comprising:

a canceling sound generator for generating a canceling sound for canceling noise;

an error signal detector for detecting an error signal based on a difference between the noise and the canceling sound;

a waveform data table for storing predetermined waveform data;

a reference signal generator for generating a reference signal based on a frequency of the noise by successively reading the predetermined waveform data from the waveform data table;

a first adaptive filter for multiplying the reference signal by a filter coefficient to generate a control signal;

a subtractor for subtracting the control signal from the error signal to generate a corrected error signal;

a filter coefficient updater for sequentially updating the filter coefficient of the first adaptive filter to minimize the corrected error signal, based on the reference signal and the corrected error signal;

an adjustment reference signal generator for generating an adjustment reference signal based on the sound transfer characteristics from the canceling sound generator to the error signal detector by successively reading waveform data from the waveform data table from a read position, which is shifted a prescribed quantity from a read position used for reading the reference signal from the waveform data, such that a phase of the canceling sound is opposite in phase to the road noise; and a second adaptive filter for multiplying the adjustment reference signal by the filter coefficient to generate a canceling signal, wherein the canceling sound generator generates the canceling sound based on the canceling signal.

2. An active noise control apparatus according to claim 1, further comprising:

an amplitude adjuster for adjusting the amplitude of the canceling signal and outputting the adjusted canceling signal to the canceling sound generator.

3. An active noise control apparatus according to claim 1, wherein the adjustment reference signal generator uses, as the prescribed quantity, a phase quantity corresponding to a value produced by multiplying the reciprocal of the sound transfer characteristics from the canceling sound generator to the error signal detector by −1, and the adjustment reference signal generator generates the adjustment reference signal, which is shifted in phase by the phase quantity from the reference signal.

* * * * *